US007524022B2

(12) United States Patent
Tomita et al.

(10) Patent No.: US 7,524,022 B2
(45) Date of Patent: Apr. 28, 2009

(54) HEAD MODULE, LIQUID DISCHARGE HEAD, AND LIQUID DISCHARGE APPARATUS

(75) Inventors: Manabu Tomita, Kanagawa (JP); Shogo Ono, Kanagawa (JP); Iwao Ushinohama, Kanagawa (JP); Takaaki Murakami, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/052,391

(22) Filed: Mar. 20, 2008

(65) Prior Publication Data

US 2008/0239010 A1 Oct. 2, 2008

(30) Foreign Application Priority Data

Mar. 30, 2007 (JP) ..... 2007-090859

(51) Int. Cl.
*B41J 2/25* (2006.01)

(52) U.S. Cl. ..... 347/42; 347/58

(58) Field of Classification Search ..... 347/12, 347/13, 40, 57–59
See application file for complete search history.

(56) References Cited

U.S. PATENT DOCUMENTS 6,616,268 B2 * 9/2003 Parish ..... 347/58
7,055,936 B2 * 6/2006 Imai et al. ..... 347/58
7,287,832 B2 * 10/2007 Hayasaki ..... 347/50

FOREIGN PATENT DOCUMENTS

JP 3405757 7/2003
JP 2005-138528 6/2005

* cited by examiner

*Primary Examiner*—Lamson D Nguyen
(74) *Attorney, Agent, or Firm*—Sonnenschein Nath & Rosenthal LLP

(57) ABSTRACT

A head module includes lines of head chips, each head chip having energy-generating elements for discharging liquid and electrodes for electrically connecting the energy-generating elements to a control substrate, and a wiring board having wires for electrically connecting the electrodes to the control substrate. The head module drives the energy-generating elements through the wiring board to discharge liquid. The wiring board includes connecting sections connecting the wires to the respective electrodes, common wire sections joining some of the wires that are common to the head chips, and a terminal section connecting the wires to the control substrate at one side of the wiring board. The wires in the connecting and terminal sections are arranged in a single-layer structure along a horizontal direction. The wires in the common wire sections are arranged in a multi-layer structure in which portions of the wires are stacked in the vertical direction.

9 Claims, 13 Drawing Sheets

HEAD MODULE, LIQUID DISCHARGE HEAD, AND LIQUID DISCHARGE APPARATUS

CROSS REFERENCES TO RELATED APPLICATIONS

The present invention contains subject matter related to Japanese Patent Application JP 2007-090859 filed in the Japanese Patent Office on Mar. 30, 2007, the entire contents of which are incorporated herein by reference.

BACKGROUND OF THE INVENTION

1. Field of the Invention

The present invention relates to a head module for discharging liquid by driving energy-generating elements included in head chips via a wiring board, a liquid discharge head including a plurality of the head modules, and a liquid discharge apparatus including a plurality of the head modules. More particularly, the present invention relates to a technique for greatly reducing a space used for establishing connection to the wiring board.

2. Description of the Related Art

A line-head inkjet printer is an example of a liquid discharge apparatus in which nozzles for discharging ink (liquid) are arranged over a length corresponding to the width of a recording sheet. Such an inkjet printer includes a line head (liquid discharge head) having heating resistors (energy-generating elements) for discharging ink. The heating resistors are arranged so as to face the respective nozzles and are driven to discharge the ink from the nozzles.

The line-head inkjet printer is capable of printing an image having a width corresponding to the width of the recording sheet using the line head. Unlike a serial inkjet printer, which prints an image by moving a serial head (liquid discharge head) along the width of a recording sheet, a mechanism for the movement along the width direction of the recording sheet is not included in the line-head inkjet printer. Therefore, the line-head inkjet printer is advantageous in that vibration and noise can be reduced and the printing speed can be greatly increased.

The line head includes two head-chip lines in each of which relatively small head chips having heating resistors arranged therein are arranged in a certain direction. The head chips included in the two head-chip lines are arranged in a staggered pattern so that the overall length of the head chips corresponds to the width of the recording sheet. An example of such a line head is disclosed in Japanese Patent No. 3405757 (hereinafter called Patent Document 1).

According to Patent Document 1, the entire body of the line head is manufactured as a single product. Therefore, if a portion of the line head is defective due to, for example, a defect in a certain head chip, the entire line head is determined to be defective. Therefore, quality management of the line head is difficult and mass productivity thereof is low. If a portion of the line head malfunctions, the entire body of the line head is replaced by another line head and high repair costs are incurred.

To overcome the above-described disadvantages, a line head obtained by combining a plurality of head modules together has been developed. Each head module includes head chips that are arranged to form head-chip lines over a length corresponding to a fraction of the width of the recording sheet. Each of the head chips in the head-chip lines has electrodes connected to wires provided on a wiring board. The head modules are combined together to from a line head having a length corresponding to the width of the recording sheet. An example of such a line head is disclosed in Japanese Unexamined Patent Application Publication No. 2005-138528 (hereinafter called Patent Document 2).

The module-type line head is expected to reduce the fraction defective and increase the mass productivity because production and quality management can be carried out in units of head modules. In addition, service efficiency can be improved because the defective head modules can be individually replaced by other head modules. In addition, line heads can be provided in various sizes by changing the number and combination of the head modules. Accordingly, the line heads can be efficiently designed and manufactured.

SUMMARY OF THE INVENTION

However, according to Patent Document 2, a large space is used for establishing connection between a control board and the electrodes on the head chips. In the line head disclosed in Patent Document 2, four head modules are combined together so that the overall length corresponds to the width of the recording sheet. Each head module includes two head-chip lines in each of which two head chips are arranged in a certain direction. In each head module, the head chips in the head-chip lines (four head chips in total) are arranged in a staggered pattern. Four lines of head modules are provided for discharging inks of four colors: yellow (Y), magenta (M), cyan (C), and black (K). Therefore, 16 head modules are used in total.

Each of the head modules includes a wiring board having wires. The wires are connected to the electrodes on the head chips at one end thereof and have a terminal section to be inserted into a connector provided on the control board at the other end thereof. In the assembly process of the line head, 16 terminal sections are respectively connected to 16 connectors. Therefore, a large work space is used for the connecting process. Distances between the connectors are preferably increased for assembling the line head in a short time.

The number of head modules can be reduced by increasing the number of head chips included in each head module, and the number of connecting sections between the control board and the wiring boards can be reduced accordingly. However, in such a case, the number of wires in each wiring board is increased, which leads to an increase in the width of the terminal sections. Therefore, the wiring structure becomes complex and the number of steps is increased in the manufacturing process of the wiring board and the assembly process of the head module. Thus, the processes become cumbersome. In addition, a large work space is used for connecting the terminal sections having a large width to the respective connectors on the control substrate.

FIG. 12 is a plan view of a wiring board 50 according to a first comparative example.

The wiring board 50 according to the first comparative example shown in FIG. 12 has a structure similar to that according to Patent Document 2 except the number of head chips 20 included in each head module is increased from four to six.

As shown in FIG. 12, each of the head chips 20 includes a plurality of electrodes 23 (electrodes for circuit power source, heating-resistor driving, clock, data communication, ground, other control signals, etc.). The wiring board 50 has wires 51 connected to the respective electrodes 23 in a connecting section 51*a* provided at one end thereof. The wires 51 have a terminal section 51*c* for connecting each wire 51 to a control substrate (not shown). The terminal section 51*c* is formed by collecting the wires 51 at a side of one of two head-chip lines 20*a*.

The terminal section 51*c* is formed by collecting the wires 51, and therefore the width of the terminal section 51*c* is increased as the number of wires 51 (the number of head chips 20) is increased. Therefore, even if the number of head chips 20 included in each head module is increased from four as in Patent Document 2 to six as shown in FIG. 12, it is difficult to reduce the space used for providing the electrical connection for the head modules.

On the other hand, according to Patent Document 1, the entire body of the line head is manufactured as a single product. Therefore, the number of wires 51 provided on the wiring board 50 and connected to the electrodes 23 on the head chips 20 is larger than that in the above-described structure. Therefore, to prevent the width of the terminal section 51*c* on the wiring board 50 from being excessively increased, two wiring boards 60 are used, as described below.

FIG. 13 is a plan view of wiring boards 60 according to a second comparative example.

Similar to the line head disclosed in Patent Document 1, according to the second comparative example illustrated in FIG. 13, two wiring boards 60 are respectively provided for two head-chip lines 20*a*.

In the second comparative example illustrated in FIG. 13, the number of head chips 20 included in each head module is six, similar to the first comparative example illustrated in FIG. 12. In the second comparative example illustrated in FIG. 13, the wiring boards 60 have connecting sections 61*a* connected to respective head-chip lines 20*a*. Since two wiring boards 60 are provided and the number of wires 61 in each wiring board 60 is reduced to one-half, the width of each terminal section 61*c* is reduced.

However, since the number of terminal sections 61*c* of the wiring boards 60 is increased to two in FIG. 13, a large work space is used for connecting the terminal sections 61*c* of the wiring boards 60 to a control substrate (not shown). In addition, distances between connectors (not shown) on the control substrate are preferably increased to finish the connecting process in a short time.

Accordingly, there are many problems in the process of providing connection to the control substrate (not shown) using the wiring board 50 according to the first comparative example or the wiring boards 60 according to the second comparative example. Unless these problems can be solved, it is difficult to ensure the mass productivity and assembly performance of the line head.

Therefore, it is desirable to reduce the space used for connecting the wiring boards to the control substrate while increasing the mass productivity and assembly performance of the line head.

According to an embodiment of the present invention, a head module includes a plurality of head-chip lines, each head-chip line having a plurality of head chips arranged in a certain direction, each head chip having energy-generating elements for discharging liquid and electrodes for electrically connecting the energy-generating elements to a control substrate; and a wiring board having wires for electrically connecting the electrodes on the head chips to the control substrate. The head module drives the energy-generating elements in the head chips through the wiring board to discharge liquid. The wiring board includes connecting sections configured to connect the wires to the respective electrodes on the head chips in the respective head-chip lines, common wire sections configured to join some of the wires that are common to the head chips in the respective head-chip lines, and a terminal section configured to connect the wires to the control substrate at one side of the wiring board. The wires in the connecting sections and the terminal section are arranged in a single-layer structure along a horizontal direction. The wires in the common wire sections are arranged in a multi-layer structure in which portions of the wires are stacked in the vertical direction.

According to another embodiment of the present invention, a liquid discharge head includes a plurality of the above-described head modules. According to still another embodiment of the present invention, a liquid discharge apparatus includes a plurality of the above-described head modules.

In the above-described embodiments, the wiring board includes the connecting sections configured to connect the wires to the respective electrodes on the head chips in the respective head-chip lines, the common wire sections configured to join some of the wires that are common to the head chips in the respective head-chip lines, and the terminal section configured to connect the wires to the control substrate at one side of the wiring board. The wires in the connecting sections and the terminal section are arranged in a single-layer structure along a horizontal direction, and the wires in the common wire sections are arranged in a multi-layer structure in which portions of the wires are stacked in the vertical direction. Therefore, the common wires are joined together in the common wire sections having a multi-layer structure and disposed between the terminal section and the connecting sections. Accordingly, the number wires in the terminal section is reduced. The terminal section is disposed at one side of the wiring board.

According to the present invention, in the wiring board, the common wire sections having a multi-layer structure are placed between the terminal section connected to the control substrate and the connecting sections connected to the electrodes of the head chips. The wires common to the head chips are joined together by the common wire sections. Therefore, the number of wires in the terminal section and the width of the terminal section are reduced. In addition, the terminal section is disposed at one side of the wiring board. Therefore, the wiring board can be electrically connected to the control substrate by the thin terminal section disposed at one side of the wiring board. As a result, the space used for the connecting process can be greatly reduced.

DESCRIPTION OF THE PREFERRED EMBODIMENT

An embodiment of the present invention will be described below with reference to the accompanying drawings.

A color inkjet printer will be described as a liquid discharge apparatus according to an embodiment of the present invention. The color inkjet printer is capable of discharging inks (liquids) of four colors: yellow (Y), magenta (M), cyan (C), and black (K). The color inkjet printer includes a line head 1 as a liquid discharge head according to an embodiment of the present invention, and the line head 1 includes head modules 10 as head modules according to an embodiment of the present invention.

Figure 1:
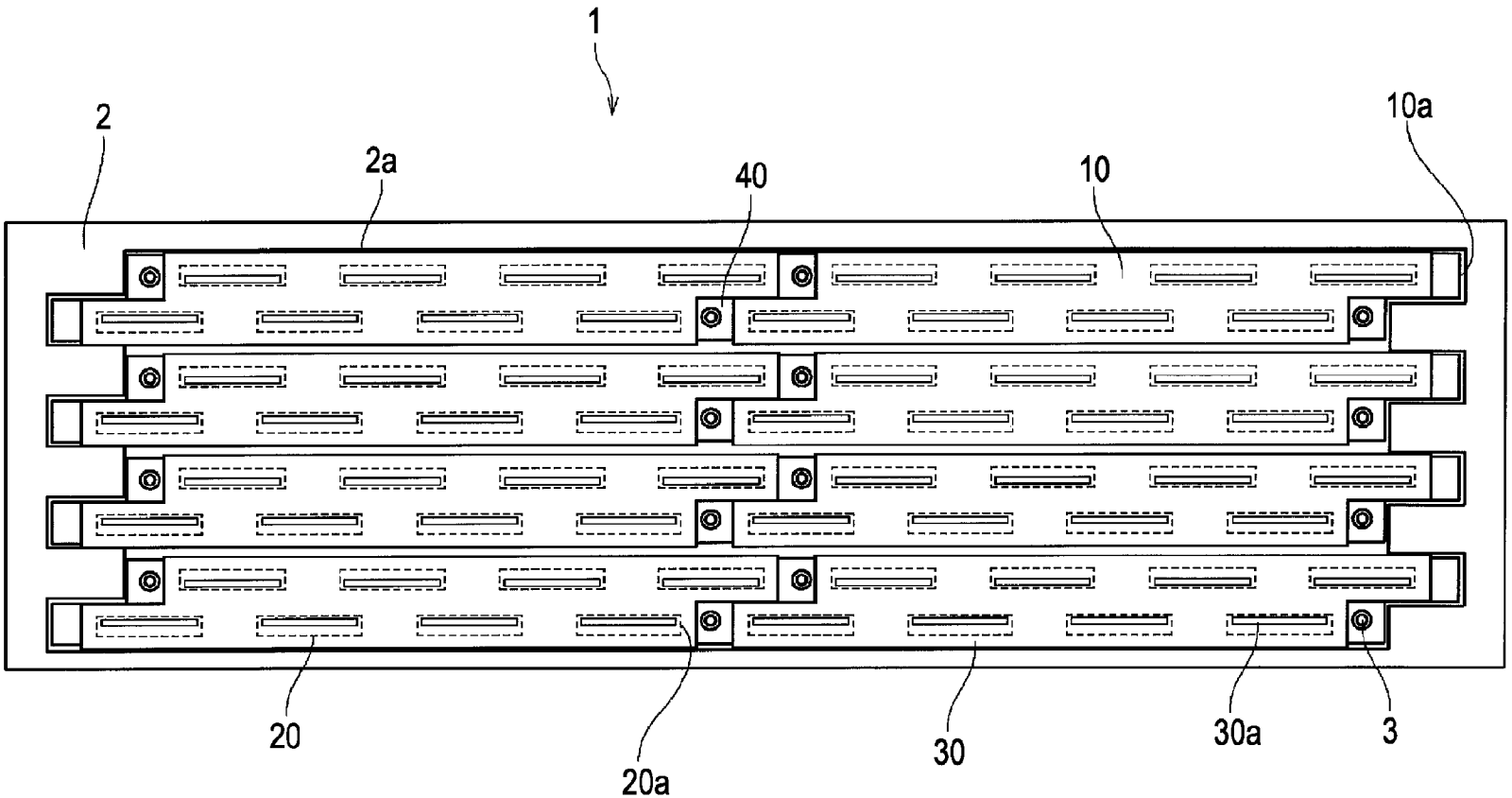
FIG. 1 is a plan view of a line head according to an embodiment viewed from an ink discharge side.

FIG. 1 is a plan view of the line head 1 according to an embodiment viewed from an ink discharge side.

Referring to FIG. 1, the line head 1 includes a plurality of head modules 10 fixed to a head frame 2 with screws 3. The head modules 10 are arranged so as to form four head-module lines 10*a* in a head-module receiving hole 2*a* in the head frame 2. Each head-module line 10*a* includes two head modules 10 arranged in series along the longitudinal direction thereof. Each of the head-module lines 10*a* is long enough to cover the width of an A4-size recording sheet. The four head-module lines 10*a* are arranged parallel to each other and discharge inks of four colors: yellow (Y), magenta (M), cyan (C), and black (K).

Each of the head modules 10 includes two head-chip lines 20*a*, each of which includes four head chips 20. The head chips 20 in the two head-chip lines 20*a* (eight head chips 20 in total) are arranged in a staggered pattern on a flexible wiring board 30, which corresponds to a wiring board according to an embodiment of the present invention. The head chips 20 are arranged on a back surface of the flexible wiring board 30 (surface opposite to an ink-discharge surface) and are electrically connected to the flexible wiring board 30. The flexible wiring board 30 has openings 30*a* for allowing ink discharged from the head chips 20 to pass therethrough.

In each head module 10, a buffer tank 40 is disposed on the back surface of the flexible wiring board 30. The buffer tank 40 defines a common ink flow channel for ink to be discharged from the head chips 20, and is bonded to the flexible wiring board 30 so as to cover the top surfaces of the head chips 20. Thus, the head chips 20 included in each head module 10 are configured to discharge ink of a certain color that is contained in the corresponding buffer tank 40.

Figure 2:
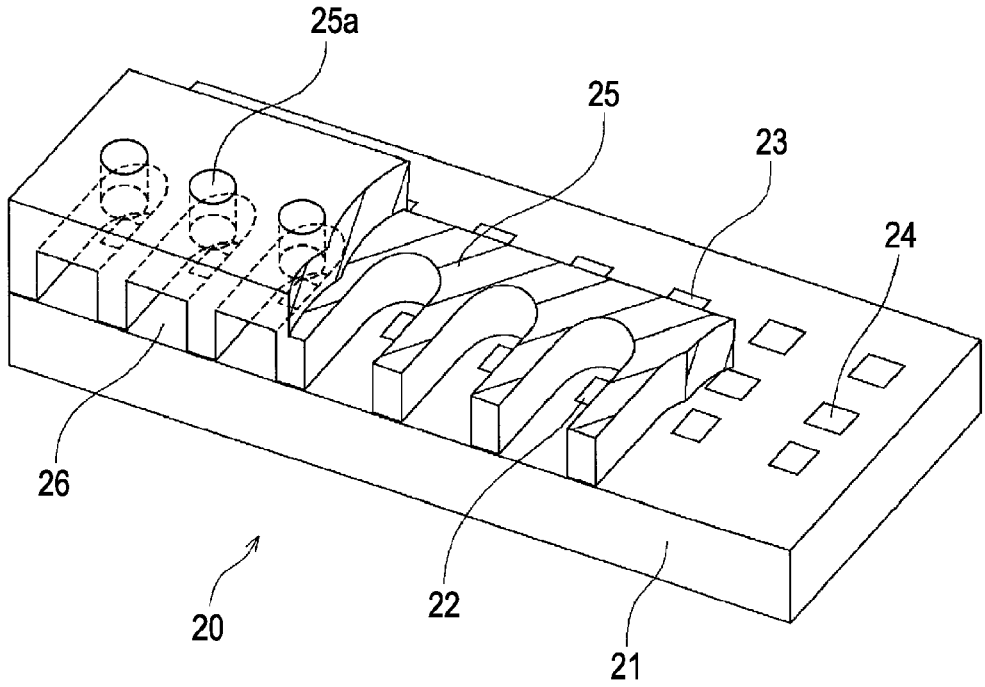
FIG. 2 is a partially broken perspective view of a head chip included in a head module according to the embodiment.

FIG. 2 is a partially broken perspective view of each of the head chips 20 included in the head modules 10 according to the present embodiment.

Referring to FIG. 2, the head chip 20 includes a plurality of heating resistors 22 for discharging ink, which correspond to energy-generating elements according to an embodiment of the present invention, and electrodes 23 for electrically connecting the heating resistors 22 to the corresponding flexible wiring board 30 (see FIG. 1). In the head chip 20, nozzles 25*a* for allowing the ink to be discharged therethrough are formed so as to face the respective heating resistors 22. Heating elements other than the heating resistors 22 (heaters or the like), piezoelectric elements, etc., may also be used as the energy-generating elements.

The head chip 20 can be manufactured using semiconductor technology. For example, the heating resistors 22 made of tantalum (Ta) are formed on one side of a semiconductor substrate 21 made of silicon (Si) or the like. The electrodes 23 for receiving externally supplied power and signals are formed on the semiconductor substrate 21 on the same side as the heating resistors 22 and along the edge opposite to the edge along which the heating resistors 22 are formed. Driver elements 24 (n-channel metal-oxide silicon (MOS) transistors) for driving the heating resistors 22 are formed between the heating resistors 22 and the electrodes 23.

Next, positive photoresist (PMER-LA900 manufactured by Tokyo Ohka Kogyo Co., Ltd. or the like) for forming ink chambers 26 is applied in a thickness of 10 μm by spin coating so as to cover the heating resistors 22. Then, the positive photoresist is exposed to light with a mask aligner, developed with a developer (3% aqueous solution of tetramethylammonium hydroxide), and rinsed with pure water. As a result, a resist pattern corresponding to the ink chambers 26 is obtained. Then, the entire surface of the resist pattern is exposed to light with the mask aligner and is then left in a nitrogen atmosphere for 24 hours.

Next, a nozzle layer 25 is formed on the resist pattern and the semiconductor substrate 21. More specifically, photocurable negative photoresist is applied in regions including the driver elements 24 by spin coating at a rotational speed controlled so that the layer thickness on the resist pattern is adjusted to 10 μm. Then, the photoresist is exposed to light with the mask aligner, developed with a developer (OK73 thinner, manufactured by Tokyo Ohka Kogyo Co., Ltd.), and rinsed with a rinse (IPA) to form the nozzle layer 25. Then, nozzles 25*a* (15 μm in diameter) are formed in the nozzle layer 25 such that the nozzles 25*a* face the corresponding heating resistors 22.

Then, the entire body is immersed in an organic solvent (PGMEA) having solubility for the resist pattern (positive photoresist) corresponding to the ink chambers 26 and supersonic vibration is applied until the resist pattern is entirely dissolved and removed. Then, a cleaning process is performed, and the ink chambers 26 are thus completed. Then, gold bumps are applied to the electrodes 23 and the semiconductor substrate 21 is cut in a desired size. As a result, the head chip 20 is completed.

In each head chip 20, the arrangement pitch of the heating resistors 22 and the nozzles 25*a* is set to about 42.3 μm, and the resolution is 600 dpi. As shown in FIG. 1, eight head chips 20 are arranged in a staggered pattern to form a single head module 10, and two head modules 10 are linearly arranged so as to overlap each other at the ends thereof. Thus, the resolution of 600 dpi can be obtained at the overall width of the A4-size recording sheet.

In each head chip 20, the ink chambers 26 are formed on the semiconductor substrate 21. The surface of the semiconductor substrate 21 on which the heating resistors 22 are formed defines the bottom surfaces of the ink chambers 26. Recessed portions of the nozzle layer 25 surrounding the heating resistors 22 define the side walls of the ink chambers 26. The surface of the nozzle layer 25 in which the nozzles 25*a* are formed defines the top surfaces of the ink chambers 26. Accordingly, openings are formed at the lower right side in FIG. 2, and the ink can be supplied to the ink chambers 26 without forming through holes in the semiconductor substrate 21. As a result, the rigidity of each head chip 20 is ensured by the semiconductor substrate 21.

The ink supplied to the ink chambers 26 are discharged when the heating resistors 22 are driven. More specifically, when the heating resistors 22 are driven by the driver elements 24, ink contained in the ink chambers 26 corresponding to the driven heating resistors 22 is discharged through the nozzles 25*a*. Therefore, the electrodes 23 are connected to the corresponding flexible wiring board 30 (see FIG. 1). As shown in FIG. 1 each head module 10 according to the present embodiment includes eight head chips 20 arranged in a staggered pattern. Therefore, each flexible wiring board 30 is connected to the electrodes 23 in eight head chips 20.

Figure 3:
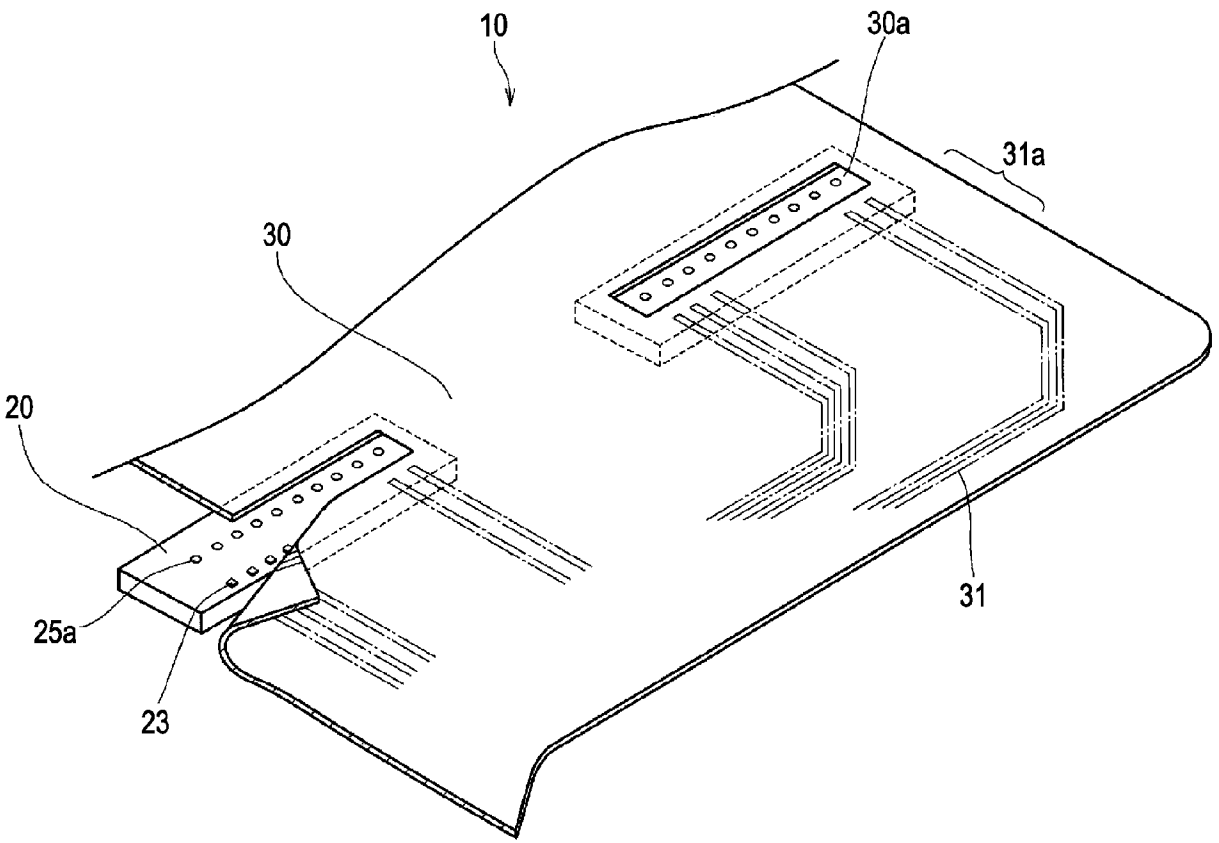
FIG. 3 is a perspective view illustrating the manner in which head chips are connected to a flexible wiring board in the head module according to the embodiment.

FIG. 3 is a partial perspective view illustrating the manner in which the head chips 20 are connected to the flexible wiring board 30 in each head module 10 according to the present embodiment. In FIG. 3, the flexible wiring board 30 is shown such that the flexible wiring board 30 is partially peeled off to facilitate understanding of the drawing.

As shown in FIG. 3, each of the head chips 20 is mounted on the back surface of the flexible wiring board 30. The flexible wiring board 30 has wires 31 for connecting the electrodes 23 in each head chip 20 to a control substrate 4 (not shown in FIG. 3), which will be described below. Thus, the heating resistors 22 (see FIG. 2) in each head chip 20 are electrically connected to the control substrate 4 through the electrodes 23 and the wires 31.

The flexible wiring board 30 has a so-called sandwich structure in which the wires 31 are disposed between films made of polyimide resin. The wires 31 are formed by laminating a copper foil on a polyimide resin film and etching the copper foil. The wires 31 are formed in a pattern corresponding to the electrodes 23 (electrodes for circuit power source, heating-resistor driving, clock, data communication, ground, other control signals, etc.) of each head chip 20.

The openings 30*a* are formed in the flexible wiring board 30. The openings 30*a* allow the ink discharged from the nozzles 25*a* of the head chips 20 to pass therethrough. The openings 30*a* are punched out in the flexible wiring board 30 by pressing a cutting die having a cutting edge against the flexible wiring board 30. The openings 30*a* may also be formed using a laser, a drill, etc.

The head chips 20 are adhered to the flexible wiring board 30 such that the nozzles 25*a* are positioned in the respective openings 30*a*. The flexible wiring board 30 has positioning marks to which the head chips 20 are positioned when the head chips 20 are mounted on the flexible wiring board 30. An adhesive sheet that can be dissolved by heat is adhered to the back surface of the flexible wiring board 30 in a region where the nozzle layer 25 (see FIG. 2) of each head chip 20 comes into contact. The process of adhering the head chips 20 to the flexible wiring board 30 is completed by applying heat after mounting the head chips 20.

Connecting sections 31*a* for connecting the wires 31 to the respective electrodes 23 of the head chips 20 are provided near the openings 30*a*. The wires 31 in the connecting sections 31*a* and the respective electrodes 23 face each other at the positions where the head chips 20 are mounted. The electrodes 23 having gold bumps can be connected to the respective wires 31 by applying pressure and heat only in regions where they face each other. The connection between the electrodes 23 and the respective wires 31 can also be provided by flying leads or wire bonding instead of using bumps.

Figure 4:
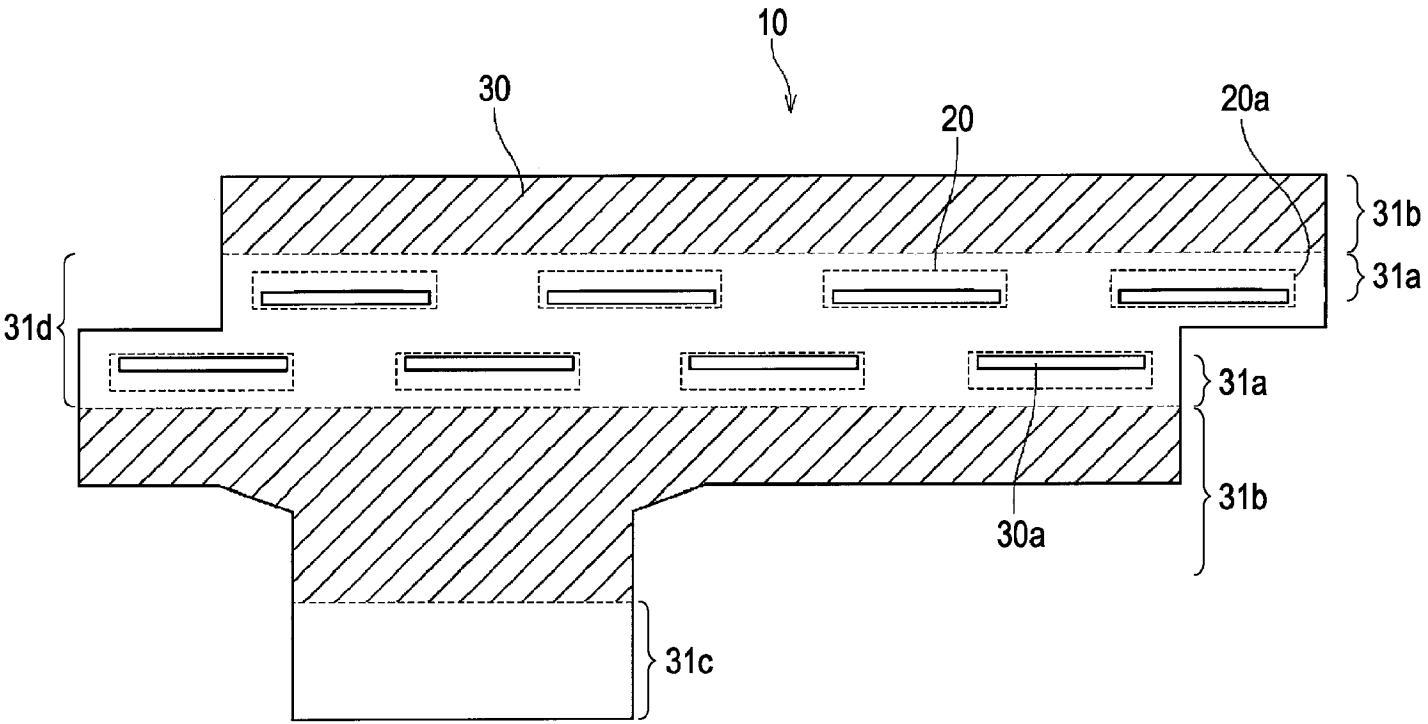
FIG. 4 is a plan view of the flexible wiring board in the head module according to the embodiment viewed from the ink discharge side.

FIG. 4 is a plan view of the flexible wiring board 30 in each head module 10 according to the present embodiment viewed from the ink discharge side.

Referring to FIG. 4, eight head chips 20 are adhered to the flexible wiring board 30 at positions corresponding to the openings 30*a*. Accordingly, two head-chip lines 20*a* are obtained which each include four head chips 20 arranged in a certain direction. The head chips 20 in the head-chip lines 20*a* are arranged in a staggered pattern.

The size of the openings 30*a* formed in the flexible wiring board 30 is larger than the size of the regions where the nozzles 25*a* (see FIG. 3) are arranged in the head chips 20. Therefore, the ink can be discharged without being blocked by the flexible wiring board 30. In addition, the adhesion accuracy of the head chips 20 can be set to a relatively low level as long as the nozzles 25*a* are not blocked by the flexible wiring board 30. Therefore, the eight head chips 20 can be arranged in a staggered pattern by a simple assembly process using a jig or the like.

The head chips 20 receive power, signals, etc., through the flexible wiring board 30. The flexible wiring board 30 includes the connecting sections 31*a* for connecting the electrodes 23 (see FIG. 3) in the head chips 20 arranged in the head-chip lines 20*a* to the respective wires 31 (see FIG. 3), common wire sections 31*b* in which the wires 31 common to the head chips 20 in the head-chip lines 20*a* are collected, and a terminal section 31*c* that provides connection between the wires 31 and the control substrate 4 (not shown in FIG. 4).

Since the two head-chip lines 20*a* are arranged next to each other, the connecting sections 31*a* are disposed outside the two head-chip lines 20*a*, and the common wire sections 31*b* are disposed outside the connecting sections 31*a*. The terminal section 31*c* is disposed next to one of the two head-chip lines 20*a* (at the lower side of the flexible wiring board 30 in FIG. 4). To connect the common wire section 31*b* disposed next to the other one of the two head-chip lines 20*a* (at the upper side of the flexible wiring board 30 in FIG. 4) to the terminal section 31*c*, a joining section 31*d* for connecting the two common wire sections 31*b* to each other is provided. The joining section 31*d* includes the connecting sections 31*a* and defines an ink discharge surface, and the openings 30*a* are formed in the joining section 31*d*.

Thus, the flexible wiring board 30 has two connecting sections 31*a* and two common wire sections 31*b* for two head-chip lines 20*a*. The two common wire sections 31*b* are connected to each other by the joining section 31*d*, and are connected to a single terminal section 31*c*. The connecting sections 31*a*, the joining section 31*d*, and the terminal section 31*c* has a single-layer structure in which the wires 31 (see FIG. 3) are arranged in a in a horizontal direction. The common wire sections 31*b* have a multi-layer structure including regions where the wires 31 are stacked in the vertical direction.

Figure 5:
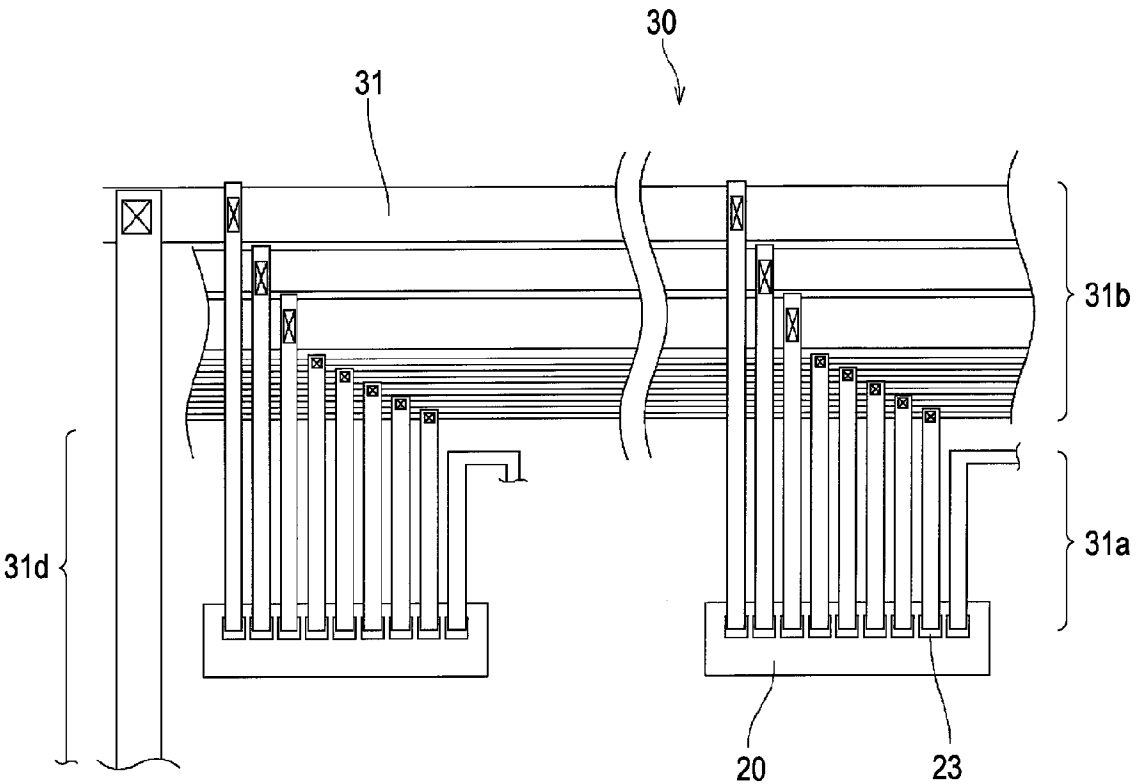
FIG. 5 is a plan view of the wiring structure of the flexible wiring board in the head module according to the embodiment.

FIG. 5 is a plan view of the wiring structure of the flexible wiring board 30 in each head module 10 according to the embodiment.

As shown in FIG. 5, in each connecting section 31*a*, the wires 31 on the flexible wiring board 30 are connected to the respective electrodes 23 in the head chips 20. The number of wires 31 included in each connecting section 31*a* corresponds to the number of electrodes 23 connected to the wires 31. Therefore, each connecting section 31*a* has a single-layer structure in which the wires 31 are arranged in a horizontal direction.

In each head chip 20, the electrodes 23 are for circuit power source, heating-resistor driving, clock, data communication, ground, other control signals, etc. Some of the electrodes 23 are for inputs common to all of the head chips 20 and others for inputs that differ between the head chips 20. More specifically, discharge data transmitted to the head chips 20 and signals representing the states of the head chips 20 are different for each head chip 20. However, electrodes for other kinds of signals and power supply are common to all of the head chips 20. Therefore, some of the wires 31 in the connecting sections 31*a* can be joined together.

Accordingly, the wires 31 common to the head chips 20 are joined together in the common wire section 31*b*. As shown in FIG. 5, each common wire section 31*b* extends in the longitudinal direction of the flexible wiring board 30. Only the wires 31 that can be joined together in each connecting section 31*a* are connected to the corresponding common wire section 31*b*. Accordingly, the number of wires 31 on the flexible wiring board 30 can be reduced while allowing individual discharge control for each of the head chips 20. The common wire sections 31*b* have a multi-layer structure including regions where the wires 31 are stacked in the vertical direction. Since the direction in which the wires 31 are arranged are changed by 90°, the width of the region where the wires 31 are arranged on the flexible wiring board 30 can be reduced.

The connecting sections 31*a* have a single-layer structure in which the wires 31 are arranged in a horizontal direction. This causes no particular problem because the width of the region where the wires 31 are arranged is determined by the number of lines along which the head chips 20 are arranged. In contrast, if the wires 31 are arranged in a multi-layer structure in the connecting sections 31*a*, the thickness of the flexible wiring board 30 is increased in regions where the head chips 20 are adhered (discharge surfaces of the head chips 20). Accordingly, the depth of the openings 30*a* (see FIG. 4) is increased and ink, dust, etc., easily remain in the openings 30*a*. Therefore, the wires 31 are arranged in a single-layer structure in the connecting sections 31*a* so as to reduce the thickness at the discharge surfaces of the head chips 20 (to reduce the depth of the openings 30*a*).

The two common wire sections 31*b* on the flexible wiring board 30 are connected to each other by the joining section 31*d*. In each common wire section 31*b*, the wires 31 common to the corresponding head chips 20 are joined together. Therefore, the number of wires 31 in the joining section 31*d* is greatly smaller than that in the connecting sections 31*a*. Accordingly, the joining section 31*d* can be formed in a single layer structure in which the wires 31 extend parallel to the wires 31 in the connecting sections 31*a* in a horizontal direction. As a result, in each head module 10 according to the present embodiment, the thickness of the flexible wiring board 30 at the discharge surfaces of the head chips 20 can be reduced. In addition, since the number of wires 31 extending across the discharge surfaces of the head chips 20 is small, the distances between the head chips 20 arranged in a staggered pattern can be reduced. Therefore, the width of each head module 10 in which use of jigs or the like is difficult due to the operation of discharging ink can be reduced.

As described above, eight head chips 20 are arranged in a staggered pattern on each flexible wiring board 30, and the wires 31 are connected to the respective electrodes 23 in each head chip 20. The wires 31 connected to the head-chip line 20*a* (see FIG. 4) next to the terminal section 31*c* (see FIG. 4) extend from the corresponding connecting section 31*a* having a single-layer structure to the terminal section 31*c* having a single-layer structure via the corresponding common wire section 31*b* having a multi-layer structure. The wires 31 connected to the head-chip line 20*a* at the side opposite to the terminal section 31*c* extend from the corresponding connecting section 31*a* having a single-layer structure to the terminal section 31*c* having a single-layer structure via the corresponding common wire section 31*b* having a multi-layer structure, the joining section 31*d* having a single-layer structure, and the other common wire section 31*b* having a multi-layer structure. The terminal section 31*c* has a single-layer structure so that the wires 31 can be connected to the control substrate 4 (not shown).

The buffer tanks 40 (see FIG. 1) are bonded to the respective flexible wiring boards 30 so as to cover the top surfaces of the head chips 20. Each buffer tank 40 is bonded to the corresponding flexible wiring board 30 and the head chips 20 such that the buffer tank 40 defines a common ink flow channel that communicates with all of the ink chambers 26 (see FIG. 2) in each head chip 20 and ink to be discharged from each head chip 20 can be supplied to all of the ink chambers 26.

Figure 6:
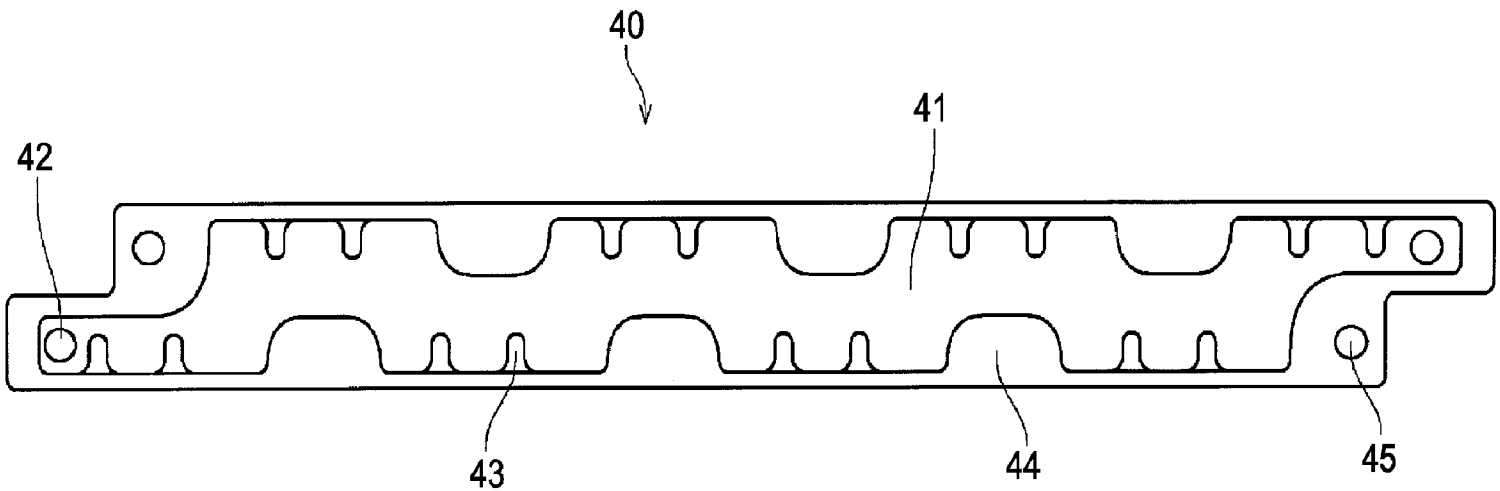
FIG. 6 is a plan view of a buffer tank included in the head module according to the embodiment viewed from the ink discharge side.

FIG. 6 is a plan view of the buffer tank 40 in each head module 10 according to the embodiment viewed from the ink discharge side.

Referring to FIG. 6, the buffer tank 40 includes a hollow common-flow-channel portion 41 that opens at one side thereof. The common-flow-channel portion 41 defines the common ink flow channel and functions as an ink supply source for the ink chambers 26 (see FIG. 2). The ink is supplied to the common ink flow channel from ink supply ports 42.

The buffer tank 40 has head-chip supports 43 for supporting the head chips 20 (see FIG. 2) such that the common ink flow channel communicates with the ink chambers 26 (see FIG. 2). The buffer tank 40 also has wiring-board supports 44 for supporting the flexible wiring board 30 (see FIG. 4). The buffer tank 40 has positioning marks used when the flexible wiring board 30 is bonded to the buffer tank 40. Each head module 10 according to the present embodiment is obtained by bonding the head chips 20, the flexible wiring board 30, and the buffer tank 40 together. The buffer tank 40 has screw holes 45 used to fix the head module 10 to the head frame 2 (see FIG. 1).

Figure 7:
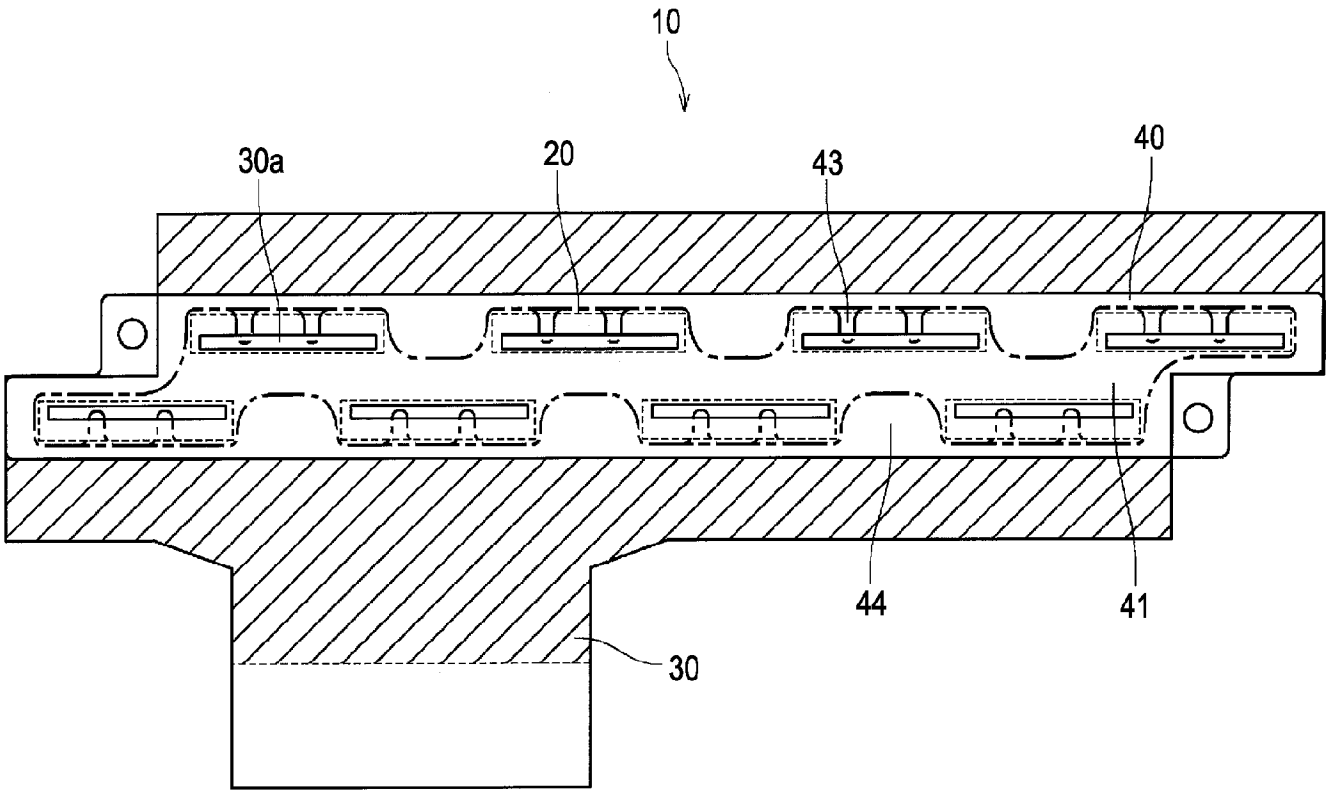
FIG. 7 is a plan view of the head module according to the embodiment viewed from the ink discharge side.

FIG. 7 is a plan view of each head module 10 according to the present embodiment viewed from the ink discharge side.

Referring to FIG. 7, in the head module 10, the flexible wiring board 30 and the head chips 20 are respectively supported by the wiring-board supports 44 and the head-chip supports 43 of the buffer tank 40.

The head chips 20 are adhered to the flexible wiring board 30 such that the electrodes 23 (see FIG. 3) in the head chips 20 face the corresponding wires 31 (see FIG. 3) on the flexible wiring board 30 and such that the ink discharged from the nozzles 25*a* (see FIG. 3) can pass through the openings 30*a* in the flexible wiring board 30. The head module 10 shown in FIG. 7 is obtained by applying an adhesive to the buffer tank 40 and bonding the flexible wiring board 30 to which the head chips 20 are adhered to the buffer tank 40.

The head chips 20 are supported by the head-chip supports 43 when the flexible wiring board 30 is bonded to the wiring-board supports 44 of the buffer tank 40. The open side of the common-flow-channel portion 41 is covered by the flexible wiring board 30, so that the common ink flow channel is formed between the flexible wiring board 30 and the common-flow-channel portion 41.

The head chips 20 are supported near the open side of the common-flow-channel portion 41 so that each of the ink chambers 26 (see FIG. 2) communicates with the common ink flow channel. The rigidity of each head chip 20 is ensured by the semiconductor substrate 21 (see FIG. 2). Therefore, the head chips 20 are prevented from breaking even though they are directly supported by the head-chip supports 43. Accordingly, each of the head modules 10 according to the present embodiment is formed only of three kind of components, that is, the head chips 20, the flexible wiring board 30, and the buffer tank 40.

Figure 8:
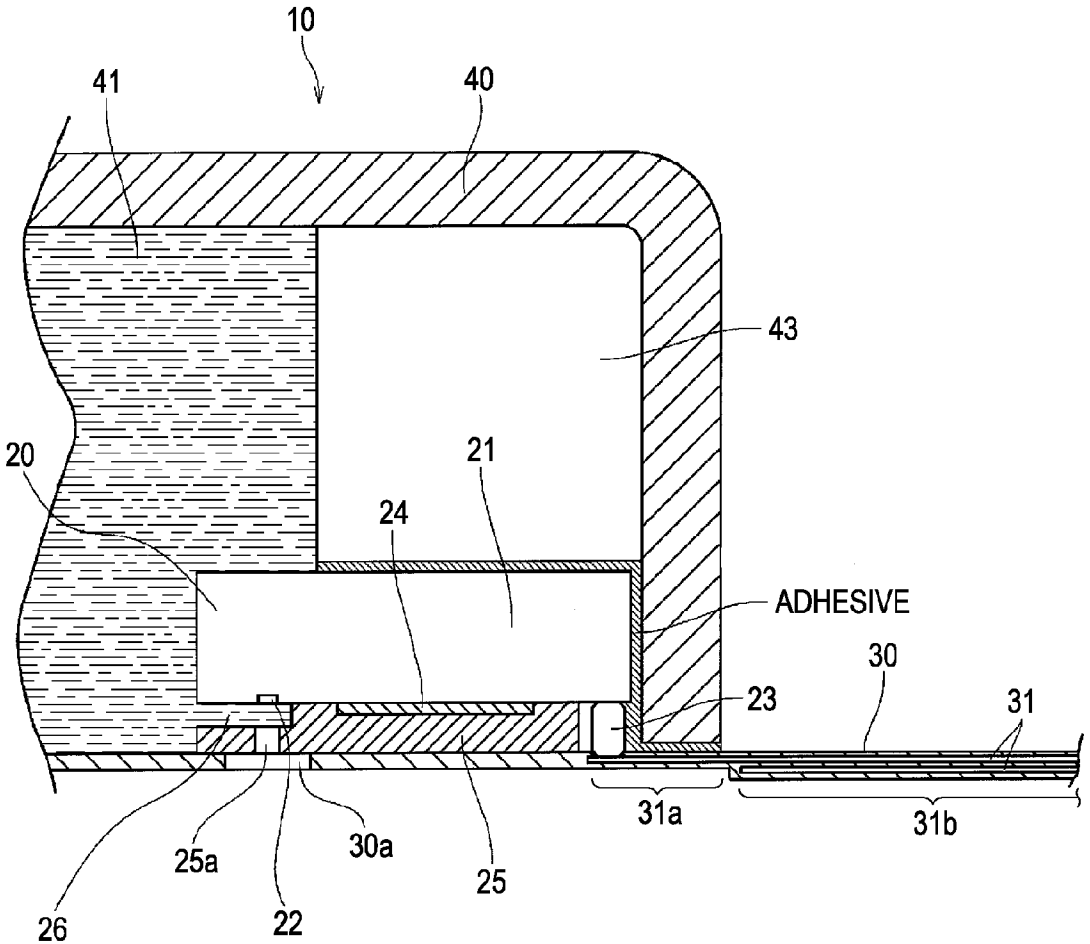
FIG. 8 is a partial sectional view of a portion around a head chip of the head module according to the embodiment.

FIG. 8 is a partial sectional view of a portion around each head chip 20 of each head module 10 according to the present embodiment.

Referring to FIG. 8, the head chip 20 is fixed with an adhesive to the corresponding head-chip supports 43 of the buffer tank 40. The flexible wiring board 30 is also bonded to the buffer tank 40. The nozzle layer 25 of the head chip 20 is adhered to the flexible wiring board 30 such that ink discharged from the nozzles 25*a* can pass through the opening 30*a*.

Thus, each head module 10 is obtained by bonding the head chips 20 and the flexible wiring board 30 to the buffer tank 40. The common ink flow channel is defined by the common-flow-channel portion 41 included in the buffer tank 40, and the common flow channel communicates with each of the ink chambers 26 in the head chips 20. More specifically, the buffer tank 40 forms the common ink flow channel common to all of the head chips 20 included in the head module 10, thereby temporarily storing ink to be supplied to the ink chambers 26.

In the flexible wiring board 30, the wires 31 are connected to the respective electrodes 23 on the head chips 20 in the connecting sections 31*a*. The common wire sections 31*b* of the flexible wiring board 30 are disposed outside the buffer tank 40. The flexible wiring board 30 is connected to the control substrate 4 (not shown) by the terminal section 31*c* (see FIG. 4).

Each head module 10 receives a command from the control substrate 4 (not shown) and selectively drives the heating resistors 22 through the driver elements 24. Accordingly, ink contained in the ink chambers 26 corresponding to the driven heating resistors 22 is discharged through the nozzles 25*a*. More specifically, a pulse current is applied to the heating resistors 22 for a short time (for example, 1 to 3 μsec) in response to a command input from the control substrate 4 while the ink chambers 26 are filled with ink. Accordingly, the heating resistors 22 are rapidly heated so that the ink boils and bubbles of ink vapor are generated in regions near the heating resistors 22. As the bubbles expand, a certain volume of ink is pushed away. As a result, the same amount of ink as the amount of ink that is pushed away is discharged through the nozzles 25*a* as ink droplets, and printing is thus performed.

To maintain the printing quality, a recovery operation is performed to remove ink, dust, etc., that remain around the nozzles 25*a*. In each head module 10 of the present embodiment, the connecting sections 31*a* of the flexible wiring board 30 have a single-layer structure. Therefore, the ink, dust, etc., can be easily removed from the areas around the nozzles 25*a*. Since the thickness of the flexible wiring board 30 in the connecting sections 31*a* forming the ink-discharge surface is not as large as that in the common wire sections 31*b* having a multi-layer structure, the depth of the depths of the openings 30*a* are relatively small. More specifically, the thickness of the common wire sections 31*b* having a multi-layer structure is about 130 μm, whereas the thickness of the connecting sections 31*a* having a single-layer structure and the openings 30*a* is about 50 μm. Therefore, the excess ink, dust, etc., can be easily removed simply by wiping the areas around the openings 30*a* with a thin, rubber blade or the like.

The line head 1 includes a plurality of head modules 10 having the above-described structure. As shown in FIG. 1, the rigid head frame 2 has the head-module receiving hole 2*a* in which eight head modules 10 are arranged in the present embodiment. In the present embodiment, two head modules 10 are linearly connected to form a single line, and four lines of the head modules 10 are provided. Each head module 10 is positioned and fixed with respect to the head frame 2 with the screws 3. In this process, the common wire sections 31*b* of the flexible wiring board 30 in the head module 10 are bent upward along the side surfaces of the buffer tank 40.

Figure 9A:
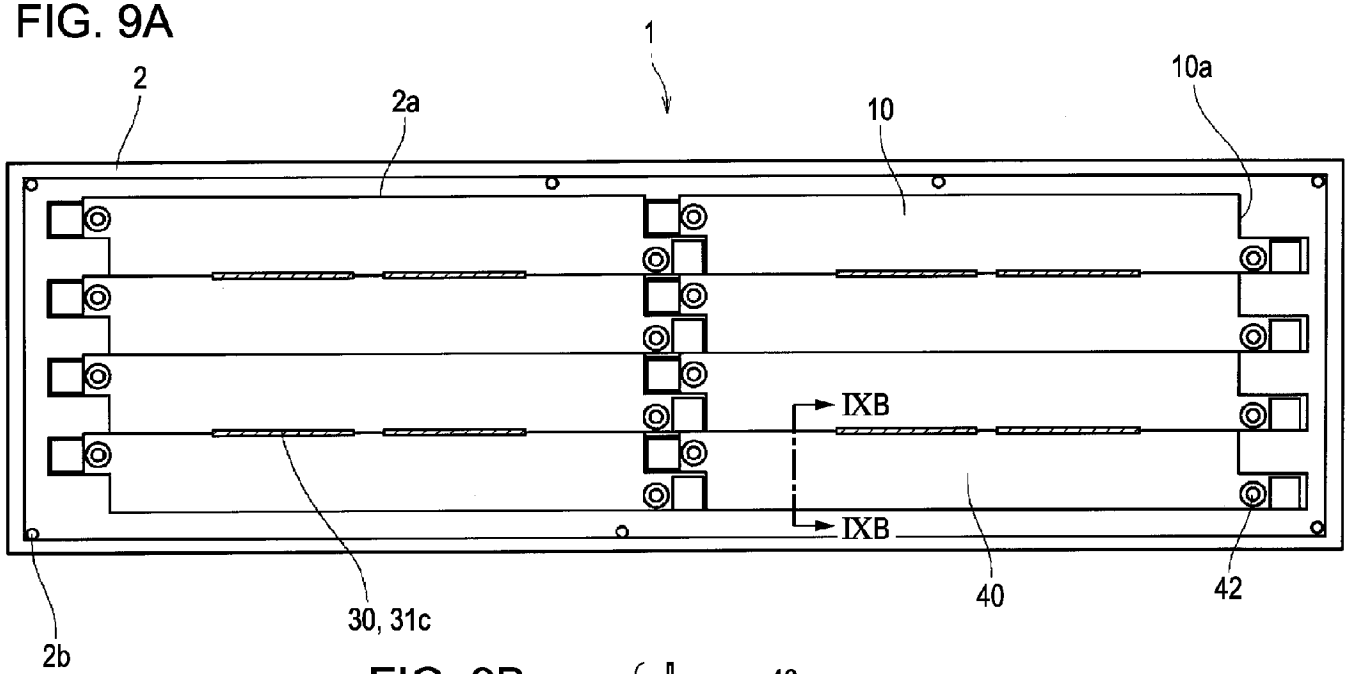
FIG. 9A is a plan view of the line head viewed from the side opposite to FIG. 1, in which the head modules according to the embodiment are all disposed on a head frame.
Figure 9B:
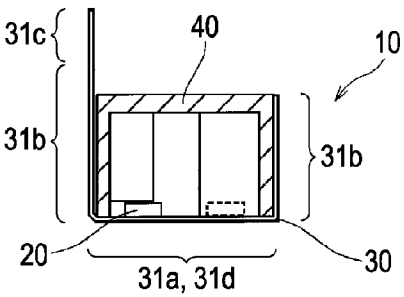
FIG. 9B is a sectional view of FIG. 9A taken along line IXB-IXB.

FIG. 9A is a plan view of the line head 1 viewed from the side opposite to FIG. 1, in which the head modules 10 according to the present embodiment are all disposed on the head frame 2. FIG. 9B is a sectional view of FIG. 9A taken along line IXB-IXB.

Referring to FIGS. 9A and 9B, each of the head modules 10 is placed inside the head-module receiving hole 2*a* formed in the head frame 2.

As shown in FIG. 9B, the flexible wiring board 30 of each head module 10 is bent upward along the side surfaces of the buffer tank 40. The flexible wiring board 30 can be easily bend due to the flexibility thereof. In the flexible wiring board 30, the connecting sections 31*a* (joining section 31*d*) having a single-layer structure serve as the ink-discharge surface. To eliminate steps from the discharge surface and to reduce the width thereof, each head module 10 is disposed in the head-module receiving hole 2*a* in the state shown in FIG. 9B by bending the common wire sections 31*b* having a multi-layer structure and disposed along the opposite sides of the flexible wiring board 30. Accordingly, the head modules 10 are disposed such that the terminal sections 31*c* of the flexible wiring boards 30 extend upward and project from the top surfaces of the head modules 10.

Thus, the terminal sections 31*c* of the flexible wiring boards 30 are exposed after the head modules 10 are placed in the head-module receiving hole 2*a*. As shown in FIG. 4, each terminal section 31*c* extends from the corresponding common wire section 31*b* and has a small width even though the terminal section 31*c* has a single-layer structure. In addition, the terminal section 31*c* is displaced from the center of the flexible wiring board 30. Therefore, referring to FIG. 9A, even when all of the head modules 10 are placed in the head-module receiving hole 2*a*, the terminal sections 31*c* are placed at different positions between the head-module lines 10*a* and do not interfere with each other.

Each of the buffer tanks 40 has the ink supply ports 42 at either end thereof. Ink is supplied to the buffer tanks 40 through the ink supply ports 42 from an ink cartridge (not shown). In addition, the control substrate 4 (not shown) is placed above the buffer tanks 40 so as to cover all of the buffer tanks 40 and is fixed by screwing screws into screw holes 2*b* formed in the head frame 2.

Figure 10:
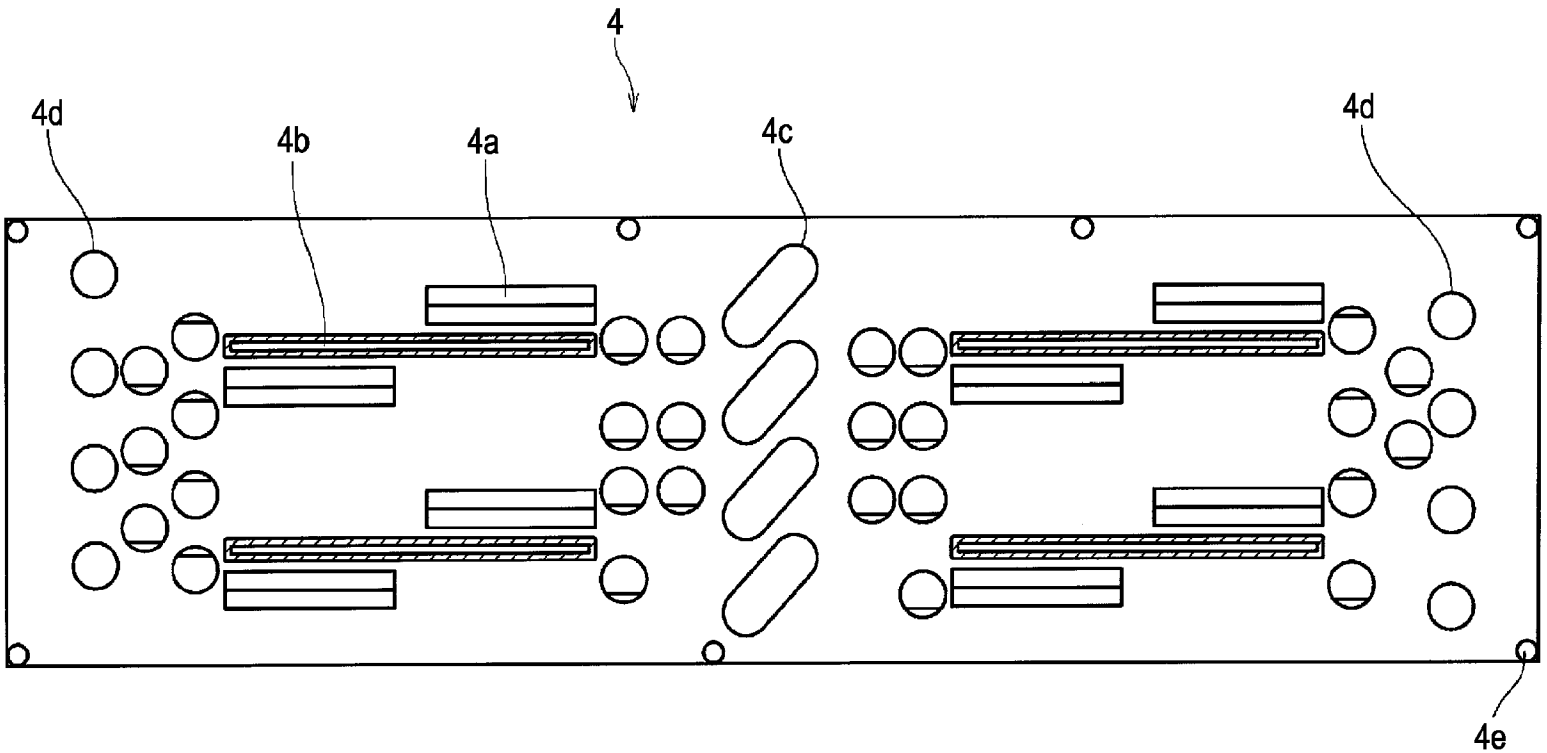
FIG. 10 is a plan view of a control substrate included in the line head according to the embodiment.

FIG. 10 is a plan view of the control substrate 4 included in the line head 1 according to the present embodiment.

The control substrate 4 shown in FIG. 10 controls the operation of discharging ink from the line head 1. The control substrate 4 has various capacitors and connectors 4*a* disposed thereon. The connectors 4*a* provides connection to the terminal sections 31*c* of the flexible wiring boards 30 shown in FIG. 9A. In addition, cutouts 4*b* for allowing the terminal sections 31*c* of the flexible wiring boards 30 to pass therethrough are formed in the control substrate 4.

The connectors 4*a* and the cutouts 4*b* are provided at positions corresponding to the terminal sections 31*c* of the flexible wiring boards 30 shown in FIG. 8. Therefore, eight connectors 4*a* are provided for two lines of four head modules 10. Thus, the number of components is minimized (16 connectors 4*a* are used in the structure described in Patent Document 2) and large intervals are provided between the connectors. The number of cutouts 4*b* is four, and each cutout 4*b* allows two terminal sections 31*c* that are disposed next to each other to pass therethrough. Two connectors 4*a* are arranged along each cutout 4*b* in a staggered pattern.

The control substrate 4 has central openings 4*c* and connecting ports 4*d* formed so as to face the ink supply ports 42 (see FIG. 9A). The central openings 4*c* are formed at the centers of the four lines of head modules 10 (see FIG. 9A) and the connecting ports 4*d* are formed at the ends of the four lines of head modules 10 (eight connecting ports 4*d* are provided in total). The control substrate 4 is fixed by screwing screws into screw holes 4*e* and the screw holes 2*b* formed in the head frame 2 in the state shown in FIG. 9A.

Figure 11A:
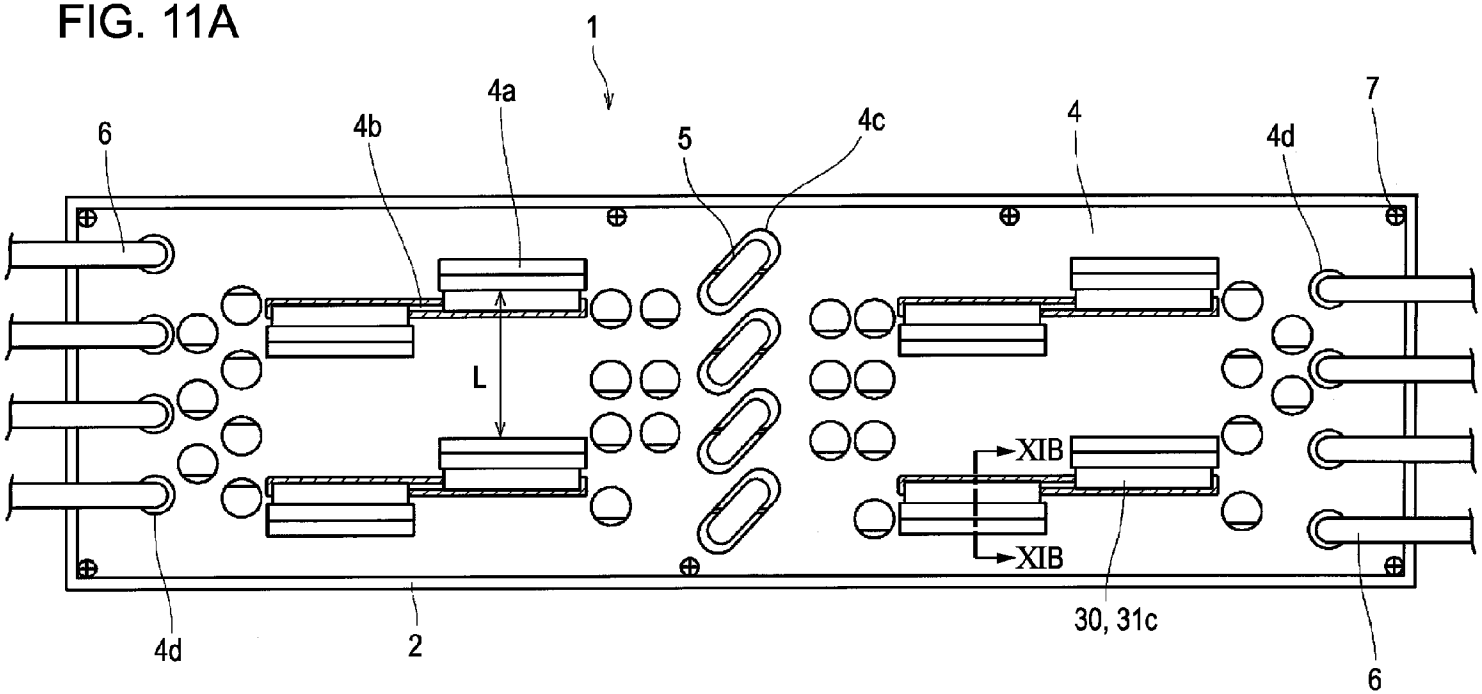
FIG. 11A is a plan view of the line head according to the embodiment viewed from the side opposite to FIG. 1.
Figure 11B:
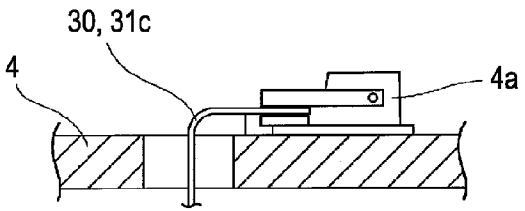
FIG. 11B is a sectional view of FIG. 11A taken along line XIB-XIB.
Figure 12:
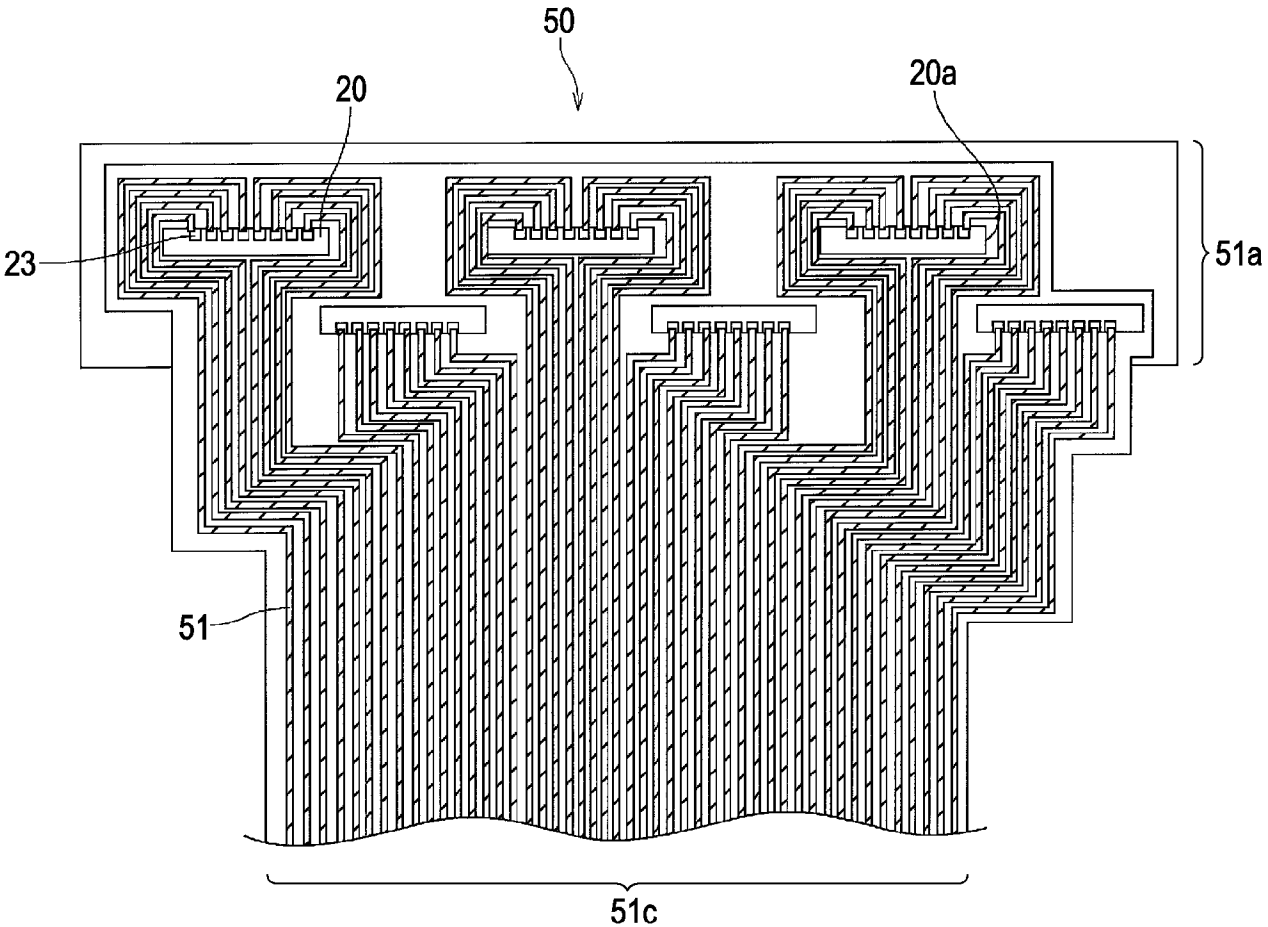
FIG. 12 is a plan view of a wiring board according to a first comparative example.
Figure 13:
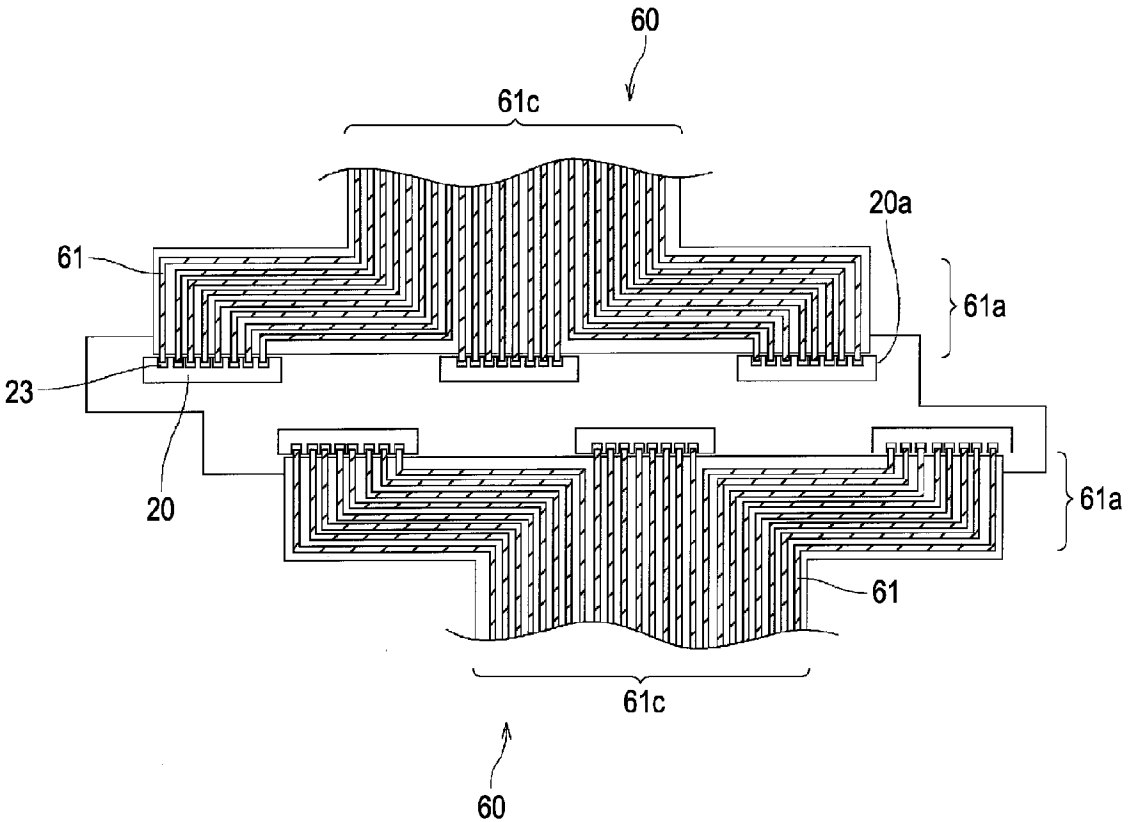
FIG. 13 is a plan view of a wiring board according to a second comparative example.

FIG. 11A is a plan view of the line head 1 according to the present embodiment viewed from the side opposite to FIG. 1, and FIG. 11B is a sectional view of FIG. 11A taken along line XIB-XIB.

Referring to FIG. 11A, the control substrate 4 is fixed to the head frame 2 with screws 7. The terminal sections 31*c* of the flexible wiring boards 30 extends upward from below the control substrate 4 through the cutouts 4*b* formed in the control substrate 4. As shown in FIG. 11B, each of the terminal sections 31*c* is bent at a right angle and is connected to the corresponding connector 4*a* having a lid that can be opened. Thus, the head modules 10 (see FIG. 9A) are electrically connected to the control substrate 4 placed behind the head modules 10 through the flexible wiring boards 30.

The connectors 4*a* to which the terminal sections 31*c* of the flexible wiring boards 30 are connected are arranged along the sides of the cutouts 4*b*. Two connectors 4*a* are arranged in a staggered pattern with the corresponding cutout 4*b* therebetween. Therefore, as shown in FIG. 11, a distance L between the connectors 4*a* is large and the connectors 4*a* can be easily handled. The terminal sections 31*c* extending from the corresponding cutouts 4*b* can be connected to the corresponding connectors 4*a* by pinching the terminal sections 31*c* one by one with fingers and inserting the terminal sections 31*c* into the corresponding connectors 4*a*. Accordingly, each of the terminal sections 31*c* having a small width can be easily inserted into the corresponding connector 4*a*, and installation of each head module 10 (see FIG. 9A) is thus completed. The terminal sections 31*c* may also be connected without using the connectors 4*a* by, for example, solder or pressure bonding.

Since the control substrate 4 has the central openings 4*c* and the connecting ports 4*d*, all of the ink supply ports 42 in the buffer tanks 40 shown in FIG. 9A and 9B are exposed and are prevented from being blocked by the control substrate 4. Therefore, the ink can be supplied to the buffer tanks 40 by inserting both ends of U-shaped pipes 5 and ends of ink-supply pipes 6 into the ink supply ports 42 from outside the control substrate 4. Each line including two buffer tanks 40 covers the width of the A4-size recording sheet, and four lines of buffer tanks 40 are arranged to discharge inks of four colors: yellow (Y), magenta (M), cyan (C), and black (K).

In the line head 1 according to the present embodiment, a single flexible wiring board 30 is connected to each head module 10, and the wires 31 on the flexible wiring board 30 extend to the terminal section 31*c* having a single-layer structure through common wire sections 31*b* having a multi-layer structure in which the wires 31 common to the head chips 20 in the head module 10 are joined together. Therefore, the flexible wiring board 30 has a single, thin terminal section 31*c*. The line head 1 includes four lines of two head modules 10. In each line of the head modules 10, two terminal sections 31*c* of two flexible wiring boards 30 extend through a single cutout 4*b* formed in the control substrate 4, and are respectively connected to two connectors 4*a* arranged in a staggered pattern with the cutout 4*b* therebetween.

Therefore, in the line head 1 according to the present embodiment, the flexible wiring board 30 has a single, thin terminal section 31*c* so that the adjacent terminal sections 31*c* can be connected to the respective connectors 4*a* within a limited space on the control substrate 4 without overlapping each other. In addition, the terminal sections 31*c* of the flexible wiring boards 30 do not reduce the installation space for surface-mount components (capacitors and the like) on the control substrate 4 or interfering with the components. As a result, the space for connecting the terminal sections 31*c* is largely reduced and the terminal sections 31*c* can be easily connected. This allows efficient production and easy assembly of the line head 1.

The ink-discharge surface of the line head 1 is formed by the connecting sections 31*a* and the joining section 31*d* having a single-layer structure in each flexible wiring board 30. Therefore, the width of the discharge surface and the thickness of the flexible wiring board 30 at the discharge surface can be reduced, and the overall width can be reduced accordingly. In addition, ink, dust, etc., remaining in the opening 30*a* in the flexible wiring boards 30 can be easily removed in the recovery operation. Thus, the print quality can be ensured.

Although the embodiment of the present invention has been described, the present invention is not limited to the above-described embodiment, and various modifications are possible as follows:

(1) In the embodiment, the nozzles 25*a* are formed in the nozzle layer 25 in each head chip 20, and each flexible wiring board 30 has openings 30*a* in the joining section 31*d* for allowing the ink discharged from the nozzles 25*a* to pass therethrough. However, the nozzles can also be formed in the joining section 31*d* in each flexible wiring board 30 instead of forming the nozzles 25*a* in each head chip 20. In such a case, the nozzles in the joining section 31*d* of each flexible wiring board 30 are arranged so as to face the respective heating resistors 22 in the corresponding head chips 20.

(2) According to the present embodiment, the terminal section 31*c* of each flexible wiring board 30 is disposed next to one of the head-chip lines 20*a* (at a longitudinal side of the flexible wiring board 30). However, the present invention is not limited to this, and the terminal sections 31*c* can also be disposed next to short sides of the flexible wiring boards 30. In this case, the connectors 4*a* are provided on the control substrate 4 at positions corresponding to the terminal sections 31*c*.

It should be understood by those skilled in the art that various modifications, combinations, sub-combinations and alterations may occur depending on design requirements and other factors insofar as they are within the scope of the appended claims or the equivalents thereof.

What is claimed is:

1. A head module comprising:

a plurality of head-chip lines, each head-chip line having a plurality of head chips arranged in a certain direction, each head chip having energy-generating elements for discharging liquid and electrodes for electrically connecting the energy-generating elements to a control substrate; and a wiring board having wires for electrically connecting the electrodes on the head chips to the control substrate, wherein the head module drives the energy-generating elements in the head chips through the wiring board to discharge liquid, wherein the wiring board includes connecting sections configured to connect the wires to the respective electrodes on the head chips in the respective head-chip lines, common wire sections configured to join some of the wires that are common to the head chips in the respective head-chip lines, and a terminal section configured to connect the wires to the control substrate at one side of the wiring board, wherein the wires in the connecting sections and the terminal section are arranged in a single-layer structure along a horizontal direction, and wherein the wires in the common wire sections are arranged in a multi-layer structure in which portions of the wires are stacked in the vertical direction.

2. The head module according to claim 1, wherein the terminal section of the wiring board connects the wires to the control board at a position next to one of the head-chip lines.

3. The head module according to claim 1, wherein the terminal section of the wiring board is at a position shifted from the center of the wiring board.

4. The head module according to claim 1, wherein the number of the head-chip lines is two, the common wire sections of the wiring board being disposed outside the two head-chip lines that are arranged next to each other, wherein the wiring board further includes a joining section configured to connect the common wire sections to each other, and wherein the wires in the joining section are arranged in a single-layer structure along a horizontal direction parallel to the direction in which the wires in the connecting sections are arranged.

5. The head module according to claim 1, wherein each of the head chips in the head-chip lines has nozzles for discharging liquid, the nozzles being arranged so as to face the respective energy-generating elements, wherein the number of the head-chip lines is two, the common wire sections of the wiring board being disposed outside the two head-chip lines that are arranged next to each other, wherein the wiring board further includes a joining section configured to connect the common wire sections to each other, and wherein the joining section has openings for allowing the liquid discharged from the nozzles to pass therethrough.

6. The head module according to claim 1, wherein the number of the head-chip lines is two, the common wire sections of the wiring board being disposed outside the two head-chip lines that are arranged next to each other, wherein the wiring board further includes a joining section configured to connect the common wire sections to each other, and wherein the joining section has nozzles for discharging liquid, the nozzles being arranged so as to face the respective energy-generating elements in the head chips in the head-chip lines.

7. The head module according to claim 1, wherein the wiring board is flexible.

8. A liquid discharge head, comprising:

a plurality of head modules; and a control substrate configured to control each of the head modules, wherein each of the head modules includes a plurality of head-chip lines, each head-chip line having a plurality of head chips arranged in a certain direction, each head chip having energy-generating elements for discharging liquid and electrodes for electrically connecting the energy-generating elements to the control substrate; and a wiring board having wires for electrically connecting the electrodes on the head chips to the control substrate, wherein the head module drives the energy-generating elements in the head chips through the wiring board to discharge liquid, wherein the wiring board includes connecting sections configured to connect the wires to the respective electrodes on the head chips in the respective head-chip lines, common wire sections configured to join some of the wires that are common to the head chips in the respective head-chip lines, and a terminal section configured to connect the wires to the control substrate at one side of the wiring board, wherein the wires in the connecting sections and the terminal section are arranged in a single-layer structure along a horizontal direction, and wherein the wires in the common wire sections are arranged in a multi-layer structure in which portions of the wires are stacked in the vertical direction.

9. A liquid discharge apparatus comprising:

a plurality of head modules; and a control substrate configured to control each of the head modules, wherein each of the head modules includes a plurality of head-chip lines, each head-chip line having a plurality of head chips arranged in a certain direction, each head chip having energy-generating elements for discharging liquid and electrodes for electrically connecting the energy-generating elements to the control substrate; and a wiring board having wires for electrically connecting the electrodes on the head chips to the control substrate, wherein the head module drives the energy-generating elements in the head chips through the wiring board to discharge liquid, wherein the wiring board includes connecting sections configured to connect the wires to the respective electrodes on the head chips in the respective head-chip lines, common wire sections configured to join some of the wires that are common to the head chips in the respective head-chip lines, and a terminal section configured to connect the wires to the control substrate at one side of the wiring board, wherein the wires in the connecting sections and the terminal section are arranged in a single-layer structure along a horizontal direction, and wherein the wires in the common wire sections are arranged in a multi-layer structure in which portions of the wires are stacked in the vertical direction.

* * * * *